US008458984B2

(12) United States Patent
Marshall

(10) Patent No.: US 8,458,984 B2
(45) **Date of Patent: *Jun. 11, 2013**

(54) SYSTEM AND METHOD FOR FORMING A MOVABLE SLAB FOUNDATION

(75) Inventor: Frederick S. Marshall, Arlington, TX (US)

(73) Assignee: Frederick S. Marshall, Dallas, TX (US)

( * ) Notice: Subject to any disclaimer, the term of this patent is extended or adjusted under 35 U.S.C. 154(b) by 290 days.

This patent is subject to a terminal disclaimer.

(21) Appl. No.: 12/844,285

(22) Filed: Jul. 27, 2010

(65) Prior Publication Data

US 2011/0023384 A1 Feb. 3, 2011

Related U.S. Application Data

(60) Provisional application No. 61/229,154, filed on Jul. 28, 2009.

(51) Int. Cl.
*E04B 1/343* (2006.01)
*E02D 27/00* (2006.01)
*E02D 27/32* (2006.01)

(52) U.S. Cl.
USPC ..... 52/745.05; 52/125.1; 52/169.9; 52/296; 405/229

(58) Field of Classification Search
USPC ..... 52/125.1, 125.4, 125.6, 126.6, 126.7, 52/292, 294, 296, 297, 299, 167.1, 167.4, 52/745.05, 126.1, 169.9, 169.13; 405/229, 405/230, 231, 235, 244, 232, 239, 251, 252, 405/256

See application file for complete search history.

(56) References Cited

U.S. PATENT DOCUMENTS

| | | | | | |
|---|---|---|---|---|---|
| 2,720,017 | A | * | 10/1955 | Youtz | 52/745.13 |
| 3,385,015 | A | * | 5/1968 | Hadley | 52/223.8 |
| 3,705,469 | A | * | 12/1972 | Eriksson | 52/125.4 |
| 4,017,115 | A | * | 4/1977 | Holt et al. | 294/89 |
| 4,405,262 | A | * | 9/1983 | Nagashima | 405/221 |
| 4,507,069 | A | * | 3/1985 | Murray et al. | 405/230 |
| 4,517,775 | A | * | 5/1985 | Engel | 52/40 |
| 4,695,203 | A | * | 9/1987 | Gregory | 405/230 |
| 4,930,270 | A | * | 6/1990 | Bevacqua | 52/126.1 |
| 4,995,204 | A | * | 2/1991 | Kelso | 52/126.1 |
| 4,997,314 | A | | 3/1991 | Hartman | |
| 5,013,190 | A | * | 5/1991 | Green | 405/230 |

(Continued)

OTHER PUBLICATIONS

U.S. Appl. No. 12/834,585, filed Jul. 12, 2010.

(Continued)

*Primary Examiner* — Basil Katcheves
*Assistant Examiner* — Rodney Mintz
(74) *Attorney, Agent, or Firm* — Bracewell & Giuliani LLP

(57) ABSTRACT

An embodiment of the system for forming a movable slab foundation as comprised by the present invention has a slab foundation, at least one substantially vertical support member, at least one support surface, and at least one support sleeve. The at least one support sleeve surrounds the at least one support member and is encased within the slab foundation and is capable of movement axially along the axis of the at least one support member. The at least one vertical support member is capable of rotation relative to the at least one support sleeve to restrict the movement of the at least one support sleeve downward relative to the at least one vertical support member, thereby maintaining the height of the at least one support sleeve and the slab foundation relative to the at least one support surface.

3 Claims, 5 Drawing Sheets

U.S. PATENT DOCUMENTS

| | | | | |
|---|---|---|---|---|
| 5,131,790 | A | 7/1992 | Simpson | |
| 5,205,673 | A * | 4/1993 | Bolin et al. | 405/230 |
| 5,228,807 | A | 7/1993 | Willcox, Jr. | |
| 5,259,702 | A | 11/1993 | Simpson | |
| 5,269,630 | A * | 12/1993 | Bolin et al. | 405/230 |
| 5,355,642 | A * | 10/1994 | Palamarz | 52/73 |
| 5,625,988 | A * | 5/1997 | Killick | 52/298 |
| 5,713,701 | A | 2/1998 | Marshall | |
| 5,860,491 | A * | 1/1999 | Fletcher | 187/203 |
| 6,193,442 | B1 * | 2/2001 | May | 405/232 |
| 6,390,734 | B1 | 5/2002 | Marshall | |
| 6,503,024 | B2 * | 1/2003 | Rupiper | 405/230 |
| 6,539,685 | B2 * | 4/2003 | Bell et al. | 52/741.15 |
| 6,551,030 | B1 * | 4/2003 | Curry | 405/251 |
| 6,634,830 | B1 | 10/2003 | Marshall | |
| 6,767,167 | B1 * | 7/2004 | Rials | 405/244 |
| 6,923,599 | B2 | 8/2005 | Kelso | |
| 7,744,316 | B2 * | 6/2010 | Kaufman | 405/230 |
| 7,967,531 | B2 * | 6/2011 | Collina et al. | 405/230 |
| 8,171,678 | B2 * | 5/2012 | Stanford et al. | 52/125.5 |
| 8,407,898 | B2 * | 4/2013 | Marshall | 29/897.33 |
| 2007/0028557 | A1 | 2/2007 | Kelly et al. | |
| 2007/0065233 | A1 * | 3/2007 | Collina et al. | 405/232 |
| 2007/0231080 | A1 * | 10/2007 | Gregory et al. | 405/230 |
| 2008/0152434 | A1 * | 6/2008 | Bracken et al. | 405/230 |
| 2008/0170912 | A1 * | 7/2008 | Kaufman | 405/232 |
| 2008/0175673 | A1 * | 7/2008 | Roberts et al. | 405/230 |
| 2008/0236061 | A1 * | 10/2008 | Hickman | 52/125.1 |
| 2009/0142140 | A1 * | 6/2009 | Collina et al. | 405/230 |
| 2009/0211178 | A1 | 8/2009 | Marshall et al. | |
| 2010/0080658 | A1 * | 4/2010 | Marshall | 405/232 |
| 2010/0186313 | A1 * | 7/2010 | Stanford et al. | 52/125.1 |
| 2010/0226725 | A1 * | 9/2010 | Kaufman | 405/230 |
| 2011/0005078 | A1 * | 1/2011 | Marshall | 29/897.3 |
| 2011/0052329 | A1 * | 3/2011 | Marshall | 405/229 |
| 2011/0056150 | A1 * | 3/2011 | Marshall | 52/125.1 |
| 2011/0116873 | A1 * | 5/2011 | Marshall et al. | 405/230 |
| 2012/0114423 | A1 * | 5/2012 | Zago et al. | 405/230 |

OTHER PUBLICATIONS

U.S. Appl. No. 12/395,033, filed Feb. 27, 2009.

* cited by examiner

SYSTEM AND METHOD FOR FORMING A MOVABLE SLAB FOUNDATION

CROSS REFERENCE TO RELATED APPLICATIONS

This application claims the benefit of and priority to U.S. Provisional Patent Application No. 61/229,154, filed on Jul. 28, 2009, and herein incorporated by reference in its entirety.

FIELD OF THE INVENTION

This invention relates in general to forming an adjustable foundation, and in particular, to a concrete slab foundation capable of being raised above the ground.

BACKGROUND OF THE INVENTION

Many structures have been built on foundations or slabs made of concrete poured on top of soil. Constant changes in the weather and moisture levels in the soil frequently cause damage to such a foundation. In many instances, the foundation may buckle or even crack. This phenomenon occurs for a variety of reasons, including uneven changes in the water content of supporting soils, uneven compacting of soils, and uneven loads being placed on soils. Over time, uneven movement in the soils under a foundation can cause a foundation to bend or crack.

Therefore, it would be desirable to provide a method and apparatus that would allow a foundation to be poured on top of soil and subsequently raised to a desired height to eliminate potential problems caused by soil movement and/or problematic soils.

SUMMARY OF THE INVENTION

An embodiment of the system for forming a movable slab foundation as comprised by the present invention has a slab foundation. At least one substantially vertical support member has a hollow body with first and second ends. The first end of the substantially vertical support member is in abutting contact with at least one support surface. At least one support sleeve surrounds the at least one support member. The at least one support sleeve is encased within the slab foundation and is capable of movement axially along the axis of the at least one support member. The at least one support sleeve has an opening through which the at least one support member extends. The opening is substantially geometrically complimentary to the at least one support member. The at least one vertical support member is capable of rotation relative to the at least one support sleeve to restrict the movement of the at least one support sleeve downward relative to the at least one vertical support member, thereby maintaining the height of the at least one support sleeve and the slab foundation relative to the at least one support surface.

An embodiment of the system for forming a movable slab foundation as comprised by the present invention has a slab foundation. At least one substantially vertical support member has a generally elliptical shaped hollow body with first and second ends. The first end of the at least one support member is in abutting contacting with at least one support surface. At least one support sleeve has a hollow body with inner and outer surfaces. The at least one support sleeve surrounds the at least one support member. The inner surface of the at least one support sleeve has a plurality of tabs extending along and radially inward from the inner surface at select intervals to thereby define a generally elliptical shaped opening. The opening is substantially geometrically complimentary to the at least one support member. The inner surface of the at least one support sleeve also has a plurality of apertures located in and extending therethrough. The outer surface of the at least one support sleeve has at least one reinforcing bar connected to and extending outwardly therefrom. The at least one support member initially extends through the substantially geometrically complimentary opening in the at least one support sleeve. The outer surface of the sleeve body and the at least one reinforcing bar are encased within the slab foundation. The at least one support sleeve and the slab foundation are capable of movement axially along the axis of the at least one support member. The at least one support member is capable of rotation relative to the at least one support sleeve to offset the at least one support member from the opening in the at least one support sleeve to thereby restrict the movement of the at least one support sleeve downward relative to the at least one support member. At least one lifting member is surrounded by the at least one support member. The at least one lifting member has a body with first and second ends, the first end being in abutting contact with the at least one support surface.

An embodiment of the present invention is directed to a method for forming a movable slab foundation. The method comprises placing a plurality of support surfaces below an intended slab foundation area. A plurality of support sleeves are placed in abutting contact with the plurality of support surfaces. The plurality of support sleeves have a geometrically shaped opening extending axially therethrough. A plurality of support members being geometrically complimentary to the openings are inserted into the openings and are placed within the plurality of support sleeves. The plurality of support members are slid down within the plurality of support sleeves and into abutting contact with the plurality of support surfaces. A slab foundation is formed such that it encases the plurality of support sleeves. The plurality of support sleeves are simultaneously lifted to move the slab foundation along the axes of the plurality of support members to a desired height. The plurality of support members are rotated relative to the plurality of support sleeves, thereby restricting the movement of the plurality of support sleeves downward relative to the plurality of support members and maintaining the desired height of the slab foundation.

BRIEF DESCRIPTION OF THE DRAWINGS

So that the manner in which the features and benefits of the invention, as well as others which will become apparent, may be understood in more detail, a more particular description of the invention briefly summarized above may be had by reference to the embodiments thereof which are illustrated in the appended drawings, which form a part of this specification. It is also to be noted, however, that the drawings illustrate only various embodiments of the invention and are therefore not to be considered limiting of the invention's scope as it may include other effective embodiments as well.

DETAILED DESCRIPTION OF THE INVENTION

The present invention now will be described more fully hereinafter with reference to the accompanying drawings in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
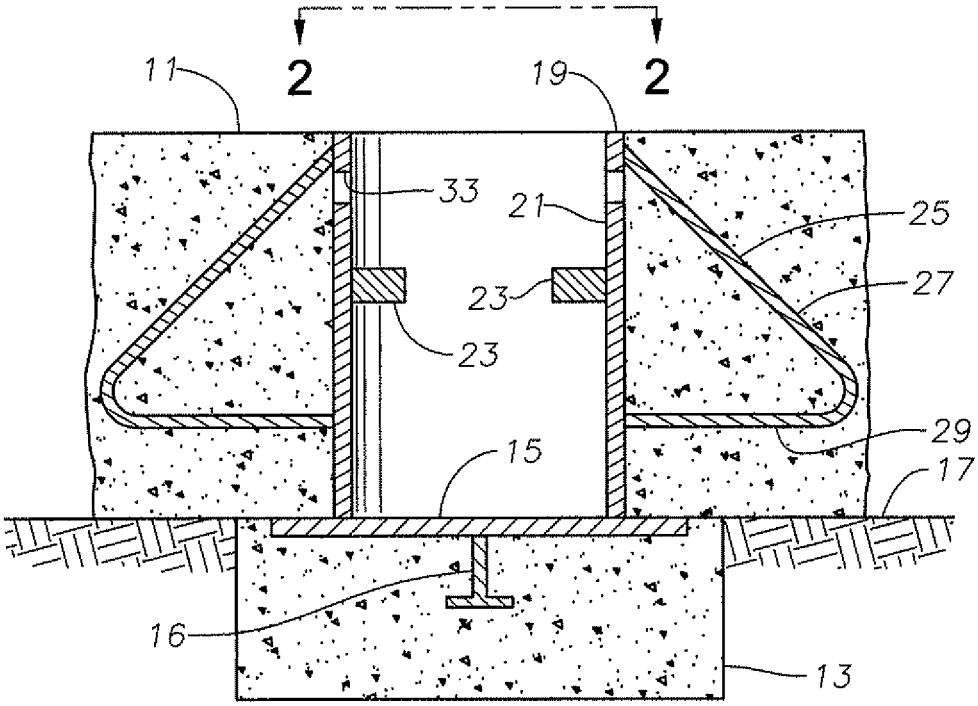
FIG. 1 is a sectional view of a single slab support, illustrating a concrete pier and a support sleeve.

Referring to FIG. 1, a foundation slab 11 may be used to support a house or other building or structure. In this embodiment, the slab 11 is of concrete and initially rests on a ground surface 17 and a support surface or pier 13. The foundation or slab 11 is typically supported by a plurality of support surfaces or piers 13, but for simplification purposes, the single pier 13 will be discussed. In this embodiment, the pier 13 is of concrete and has a base plate 15 embedded therein, such that at least the top or upper surface of the base plate 15 is exposed. In this embodiment, the base plate 15 is circular in shape, but in alternate embodiments may comprise different shapes, for example, a rectangle. In this embodiment, the base plate 15 has an anchor bolt 16 connected to it that extends a select distance into the concrete pier 13. In alternate embodiments, other support members may be connected to the base plate 15.

In this embodiment, the hole for the pier 13 is dug with a diameter such that the base plate 15 is fully encased within the concrete. Once the hole is dug as desired, the pier 13 is formed by pouring concrete into the hole. The base plate 15 is then embedded in the concrete of the pier 13 such that the top or upper surface of the base plate 15 is substantially parallel with the ground surface 17. As previously discussed, in this embodiment, the anchor bolt 16 is connected to the base plate 15 and extends into the concrete of the pier 13 a distance below base the plate 15.

Figure 2:
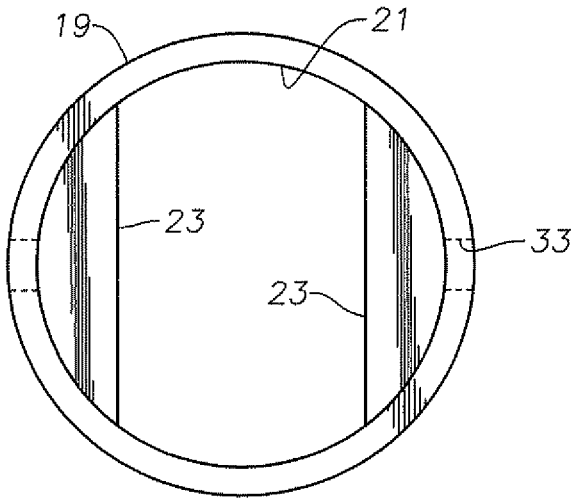
FIG. 2 is a sectional view of the support sleeve taken along the line 2-2 of FIG. 1.

In this embodiment, a cylindrical exterior pipe or support sleeve 19 has an outer diameter less than the diameter of the base plate 15. The support sleeve 19 and the base plate 15 are sized such that the bottom surface of the support sleeve 19 is in supporting contact with the base plate 15. The length of the support sleeve 19 may be less than or equal to the desired thickness of the concrete slab 11. In this embodiment, the length of the support sleeve 19 is equal to the thickness of the concrete slab 11. An inner surface 21 of the sleeve 19 has a plurality of support tabs 23 connected therein that extend along the inner diameter and radially inward a select distance. The support tabs 23 may be connected to the support sleeve 19 through various means, including, but not limited to welding and fasteners. As seen in FIG. 2, in this embodiment, two support tabs 23 are positioned opposite from one another and extend around the inner surface 21 of the support sleeve 19 at select intervals.

Referring back to FIG. 1, reinforcing bars (rebar) 25 are connected to the outer surface of the sleeve 19. In this embodiment, a first leg 27 of the rebar 25 is connected to and extends outwardly and downwardly at an angle from the sleeve 19. A second leg 29 of the rebar 25 is substantially perpendicular to the support sleeve 19 and extends between the first leg 27 and the sleeve 19. The rebar 25 may be welded around the outer peripheries of the sleeve 19 at desired intervals. In an alternate embodiment, various reinforcing members may be connected to and extend outwardly from the outer peripheries of the sleeve 19 in various shapes and configurations.

A plurality of lift holes or apertures 33 are located in and extend radially outward through the inner surface 21 of the support sleeve 19. In this embodiment, two lift holes 33 are positioned opposite from one another. The lift holes 33 are designed to accept a lifting device or lifting link.

The sleeve assembly 19 is positioned atop the base plate 15. In an alternate embodiment, the lower end of the support sleeve 19 may be lightly tack welded to the base plate 15. The concrete slab 11 is then poured, thereby embedding the rebar 25 and the sleeve assembly 19 within the slab 11. The concrete may be kept from bonding to the concrete pier 13 and the base plate 15 by an optional bond breaker layer (not shown).

Figure 3:
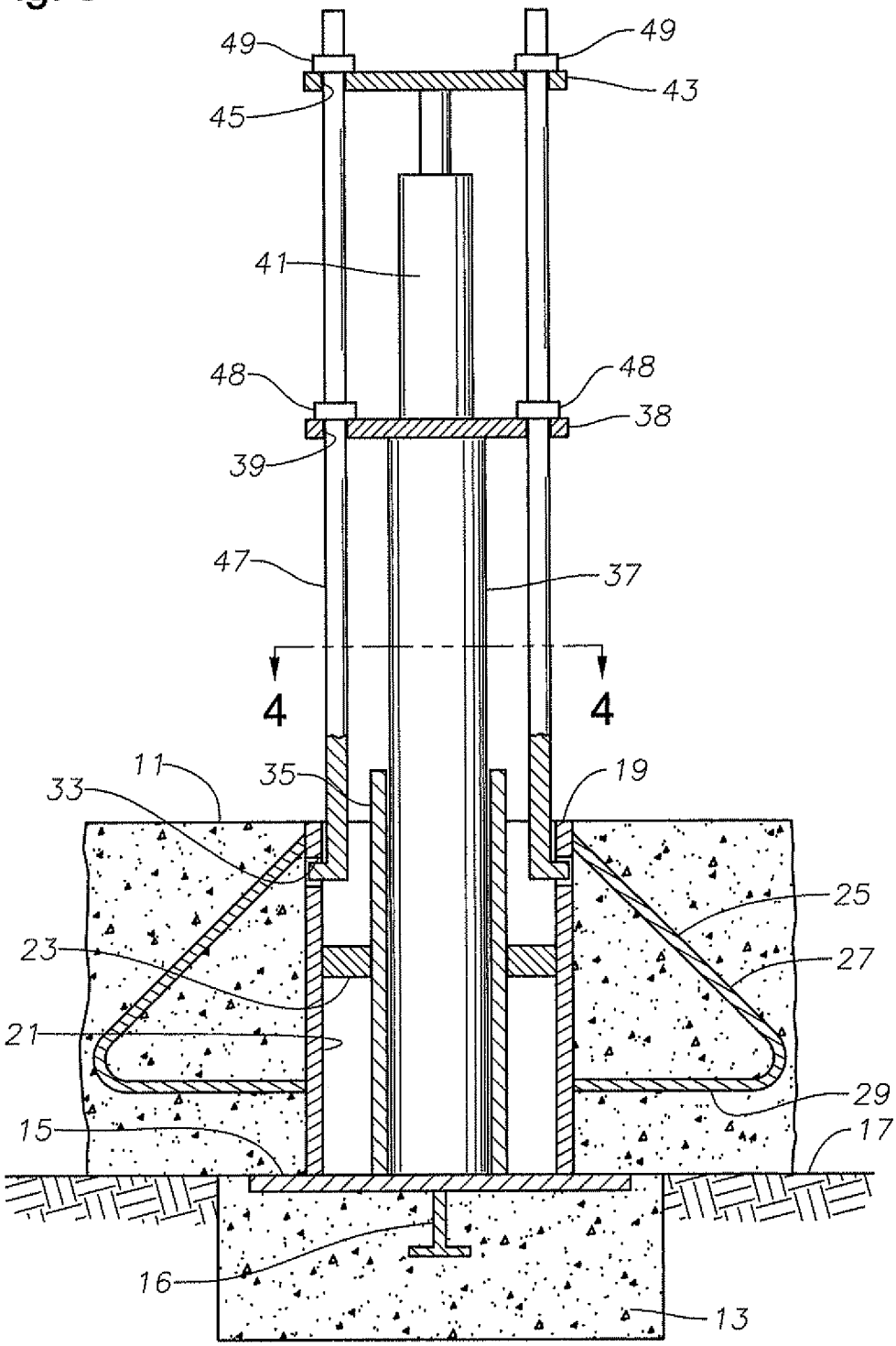
FIG. 3 is a sectional view of the single slab support with a support pipe and a lifting rod inserted and a lifting assembly connected.
Figure 4:
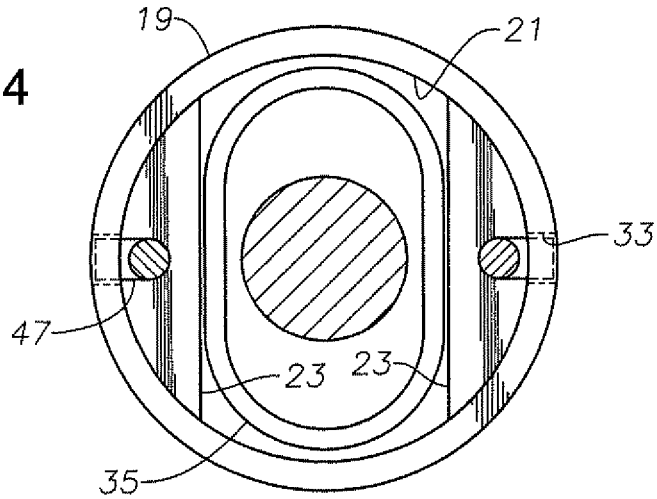
FIG. 4 is a sectional view of the support sleeve and the support pipe taken along the line 4-4 of FIG. 3.

Referring to FIG. 3, after the cement slab 11 has hardened, a support member or support pipe 35 having an elliptical shape (FIG. 4) is inserted into the sleeve 19 and lowered until a lower first end portion makes contact with the base plate 15. The elliptical shape of the support pipe 35 requires that it be properly oriented with respect to the support sleeve 19 to allow the support pipe 35 to pass by the tabs 23 on the inner surface 21 of the sleeve 19 without interference (FIG. 4). The support pipe 35 is positioned such that the lower first end portion of the support pipe 35 rests on the base plate 15. The support pipe 35 extends upwardly a selected distance from the base plate 15. The length of supporting pipe 35 can be varied to accommodate various desired slab 11 heights. As shown in FIG. 4, the support pipe 35 is elliptical in shape and is adapted to receive a lift bar 37. The desired final height of the slab 11 is determined by the length of the support pipe 35.

Referring back to FIG. 3, a lifting member or solid lifting rod 37, with a smaller diameter than the support pipe 35 is inserted into the support pipe 35 and lowered until it makes contact with the base plate 15. The length of the lifting rod 37 can be calculated such that it may remain within the support pipe 35 once the slab 11 has reached its final desired height. Alternatively, the lifting rod 37 may be removed from the support pipe 35 once the slab 11 has reached its final desired height. After the lifting rod 37 is in place, a lift support plate 38 is positioned on the top of the support rod 43. The support plate 38 has a plurality of apertures 39 located in and extending therethrough. A lifting device 41 is then mounted on the top of the support plate 38. In this embodiment, the lifting device 41 is a hydraulic jack mounted on the top of the support plate 38. A lift plate 43 is then positioned on top of the hydraulic jack 41. The lift plate 43 has a plurality of apertures 45 located in and extending therethrough. The lift plate 43 is positioned such that the apertures 45 are in alignment with the apertures 39 in the support plate 38.

Attachment members or attachment rods 47 are connected to the lift holes 33 in the sleeve 19 in order to lift the slab 11 to its desired height. In this embodiment, the attachment rods 47 contain threads in at least an upper portion thereof. The attachment rods 47 pass through the apertures 39 in the support plate 38 and the apertures 45 in the lift plate 43. Nuts 48 are threaded onto upper portions of the attachment rods 47 located between the support plate 38 and the lift plate 43. The nuts 48 may be adjusted once the slab 11 has been lifted to permit removal of the hydraulic jack 41. Nuts 49 are threaded onto upper portions of the attachment rods 47, above the lift plate 43. The nuts 49 prevent the lift plate 43 from moving upward independently from the attachment rods 47 when the hydraulic jack 41 is activated.

Figure 5:
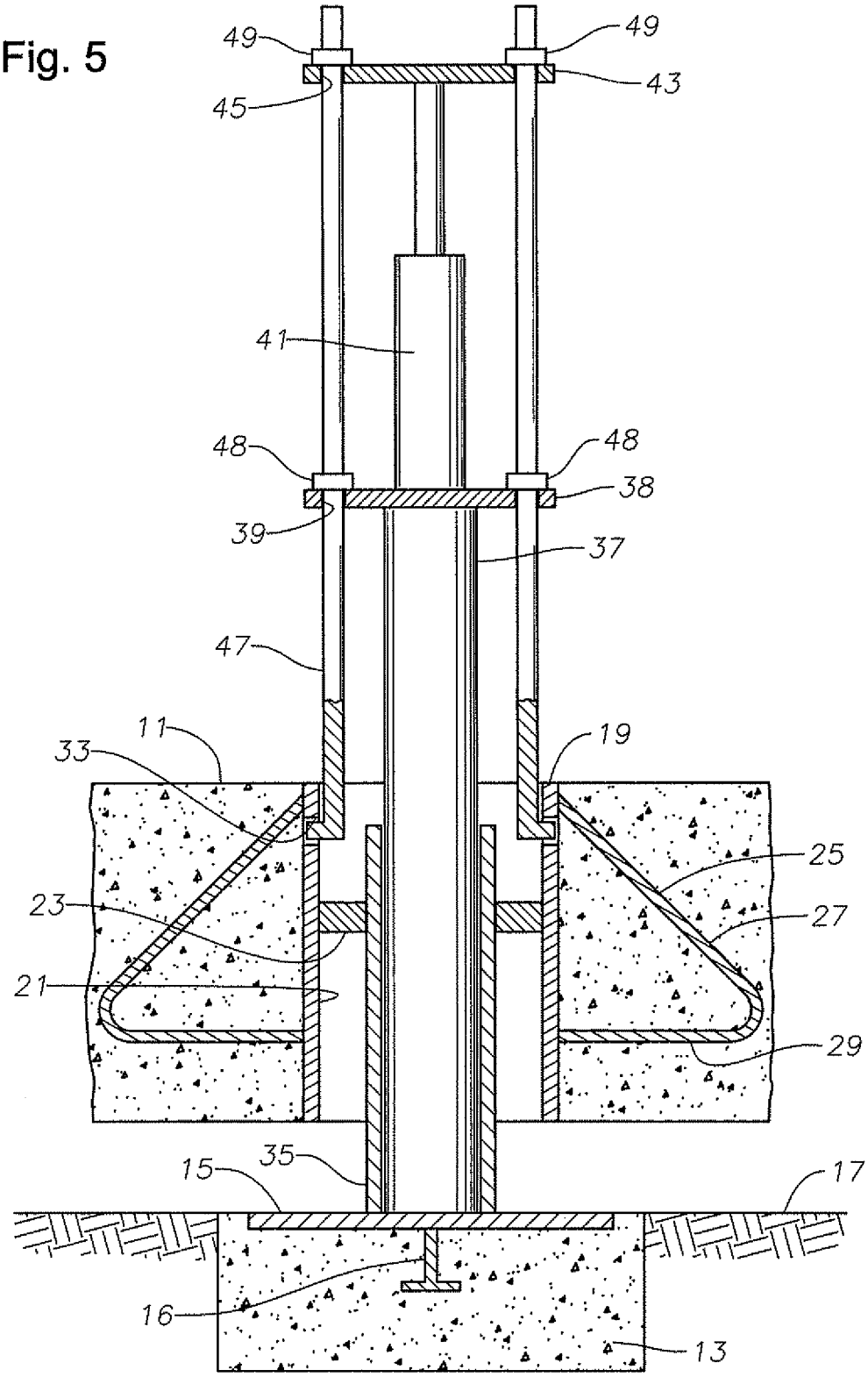
FIG. 5 is a sectional view of the single slab support with the slab raised a distance above a ground surface.

Referring to FIG. 5, hydraulic fluid pressure is applied to the jack 41, causing the jack 41 to push the lift plate 43 and the attachment rods 47 upwards relative to the base plate 15. The jack 41 moves the lift plate 43 and the attachment rods 47 upwards until the foundation slab 11 has been lifted above the ground 17 to the desired height. In the event that the hydraulic jack 41 needs to be removed during the lifting process, the nuts 48 can be tightened against the support plate 38, thereby allowing the lifting device 41 and the lift plate 43 to be removed if necessary, while maintaining the height of the slab 11.

Figure 7:
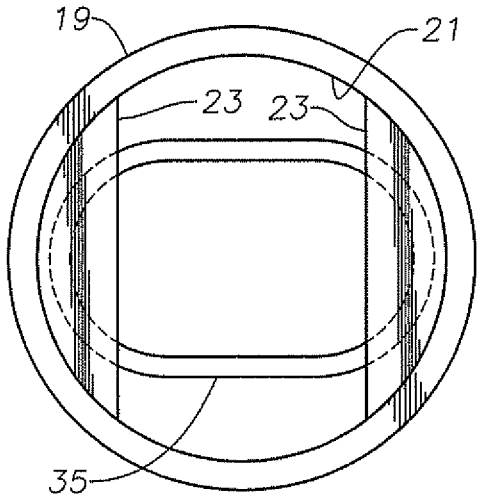
FIG. 7 is a sectional view of the support sleeve and support pipe taken along the line 7-7 of FIG. 6.
Figure 6:
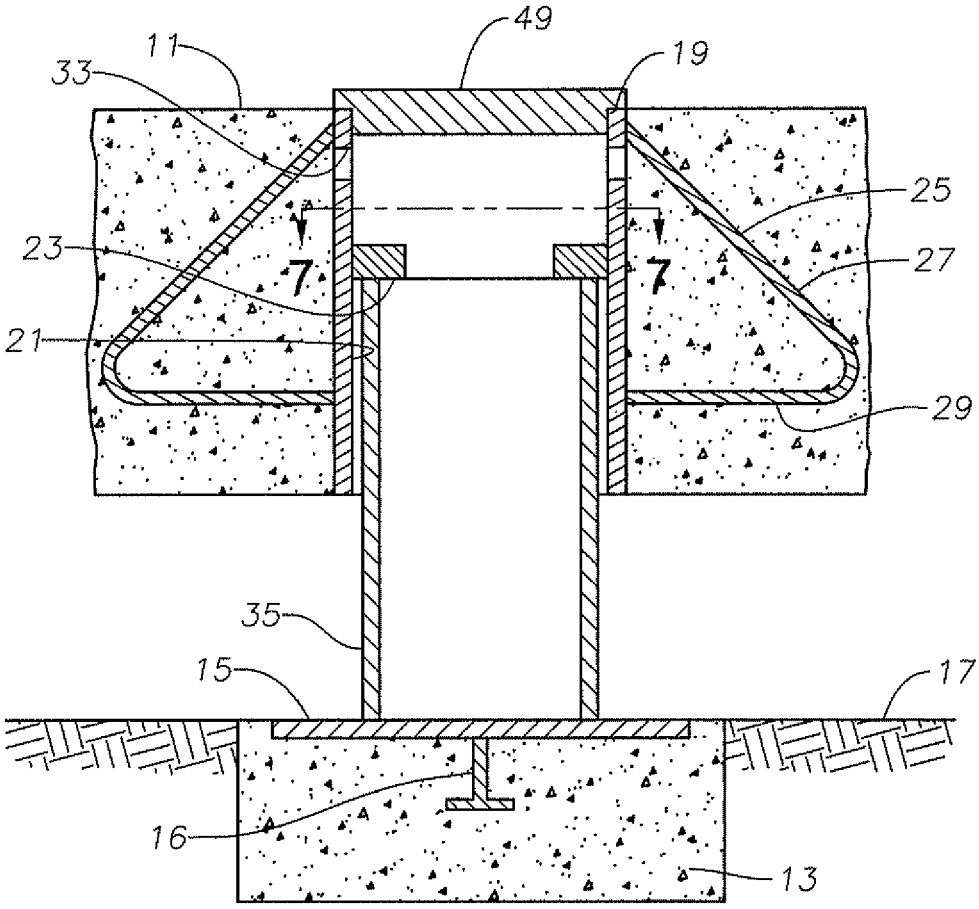
FIG. 6 is a sectional view of the single slab support with the slab raised to a final height.

Referring to FIG. 6, once the slab 11 has reached its desired final height, the tabs 23 on the inner surface 21 of the sleeve 19 will be positioned above the support pipe 35. In order to secure the slab 11 at the desired height, the support pipe 35 is then rotated such that the support tabs 23 are no longer offset from the elliptical shape of the support pipe 35 (FIG. 7). Once the support tabs 23 are positioned above the support pipe 35, and the support pipe 35 has been rotated to the proper position, the sleeve 19, the slab foundation 11, and the tabs 23 are lowered such that tabs 23 rest upon the support pipe 35. Once the tabs 23 are securely resting upon the support pipe 35, the attachment rods 47, the support plate 38, the hydraulic jack 41, the lift plate 43, and the lifting rod 37 (FIG. 5) are removed.

Referring to FIG. 6, the lifting rod 37 (FIG. 5) may be removed if its length is greater than the final height of the slab 11. Whether the lifting rod 37 is removed or remains within the support pipe 35, once the slab 11 has reach its desired height, a cap 49 can be inserted into the sleeve 19. In the event that the height of slab 11 needs to be adjusted, the cap 49 may be removed, the lifting rod 37 reinserted if not already in place, and the support plate 38, the hydraulic jack 41, the lift plate 43, and the attachment rods 47 reconnected. Once the weight of the slab 11 is lifted from the support pipe 35, the support pipe 35 is rotated such that the tabs 23 on the inner surface 21 of the sleeve 19 will not interfere with the support pipe 35. The slab 11 is lowered to its original position. The support pipe 35 may be replaced with a supporting pipe with a length to accommodate the new desired height. Once the desired height has been reached, as previously illustrated, the slab 11 may be secured in place by rotating the new support pipe and lowering the weight of the slab 11 and the sleeve 19 onto the new support pipe. As previously discussed, the hydraulic jack 41, the support plate 38, the lift plate 43, the attachment rods 47, and the lifting rod 37 may then be removed and the cap 49 reinstalled in the sleeve 19.

The invention has significant advantages. The invention provides a method and apparatus that allows a foundation to be poured on top of soil and subsequently raised to a desired height to eliminate potential problems caused by soil movement and/or problematic soils.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as set forth in the following claims.

The invention claimed is:

1. A method for forming a movable slab foundation, the method comprising:

placing a plurality of support surfaces below an intended slab foundation area;

placing a plurality of support sleeves in abutting contact with the plurality of support surfaces, each of the plurality of support sleeves having a geometrically shaped opening therein;

placing a plurality of support members geometrically complimentary to the opening within each of the plurality of support sleeves and sliding the plurality of support members down within the plurality of support sleeves and into abutting contact with the plurality of support surfaces;

forming a slab foundation such that the slab foundation encases the plurality of support sleeves;

simultaneously lifting the plurality of support sleeves to move the slab foundation to a final height;

rotating the plurality of support members relative to the plurality of support sleeves, thereby restricting movement of the plurality of support sleeves downward relative to the plurality of support members and maintaining the final height of the slab foundation;

placing a plurality of lifting members within the plurality of support members such that first ends of the plurality of lifting members are in abutting contact with the plurality of support surfaces;

connecting a plurality of lifting devices to second ends of the plurality of lifting members;

connecting the plurality of lifting devices to the plurality of support sleeves; and simultaneously actuating the plurality of lifting devices; and wherein rotating the plurality of support members relative to the plurality of support sleeves comprises offsetting the plurality of support members from the geometrically complimentary openings in each of the plurality of support sleeves.

2. The method of claim 1, wherein the plurality of support surfaces comprise a base plate encased within a concrete pier.

3. The method of claim 1, wherein actuating the plurality of lifting devices is performed by an automatic lifting system connected to control actuation of the plurality of lifting devices simultaneously.

* * * * *